United States Patent [19]

Lerma

[11] Patent Number: 4,974,621

[45] Date of Patent: Dec. 4, 1990

[54] QUICK SET-UP TENT

[76] Inventor: Larry Lerma, Rte. 1, Box 405, Abilene, Tex. 79601

[21] Appl. No.: 193,941

[22] Filed: May 13, 1988

[51] Int. Cl.[5] ..... E04H 15/44

[52] U.S. Cl. ..... 135/106; 135/905; 135/107; 135/116

[58] Field of Search ..... 135/106, 107, 108, 109, 135/116, 118, 905

[56] References Cited

U.S. PATENT DOCUMENTS

| | | | |
|---|---|---|---|
| 974,491 | 11/1910 | Huebner . | |
| 1,051,252 | 1/1913 | Parker . | |
| 1,214,979 | 2/1917 | Von Ahnen | 135/108 |
| 1,239,550 | 9/1917 | Wykert . | |
| 1,800,369 | 4/1931 | Waterhouse . | |
| 1,850,380 | 3/1932 | Carpenter . | |
| 2,277,020 | 3/1942 | Lynn | 135/905 X |
| 2,466,496 | 4/1949 | Smith . | |
| 3,008,557 | 11/1961 | Clevett . | |
| 3,034,523 | 5/1962 | DeShano . | |
| 3,367,348 | 2/1968 | Kirkham | 135/107 |
| 3,656,494 | 4/1972 | Cornett et al. | 135/116 X |
| 3,675,667 | 7/1972 | Miller . | |
| 3,896,831 | 7/1975 | Feldman et al. | 135/108 X |
| 3,941,140 | 3/1976 | Beavers . | |
| 4,069,832 | 1/1978 | Bingham | 135/107 X |
| 4,265,261 | 5/1981 | Barker | 135/108 X |
| 4,272,575 | 6/1981 | Egigian | 428/83 |
| 4,506,688 | 3/1985 | Bethoon et al. | 135/107 |
| 4,520,835 | 6/1985 | Moeller | 135/102 |

FOREIGN PATENT DOCUMENTS

| | | | |
|---|---|---|---|
| 75249 | 5/1894 | Fed. Rep. of Germany | 135/112 |
| 1518011 | 7/1978 | United Kingdom | 135/905 |

*Primary Examiner*—David A. Scherbel
*Assistant Examiner*—Lan Mai
*Attorney, Agent, or Firm*—Hubbard, Thurman, Turner, Tucker & Harris

[57] ABSTRACT

A quick set-up tent is formed from a flexible cover structure which internally carries a collapsible support structure defined by pivotally interconnected, telescopable pole members which, in their retracted positions, may be pivoted inwardly against one another to form an axially foreshortened pole bundle about which the collapsed cover structure may be conveniently wrapped to orient the tent in a compact cylindrical storage and transport configuration. The cover structure is defined by a floor section to which stake loops are attached for securing the floor section to the ground in a relatively taut configuration, and a wall section formed by at least three mutually angulated wall portions intersecuring at side edge juncture areas along which the pole members are extendable. From its compact storage and transport orientation the tent may be rapidly and easily erected simply by expanding the cover structure, staking the floor section down, and moving the pole members to their extended positions in which they are releasably locked.

18 Claims, 4 Drawing Sheets

QUICK SET-UP TENT

BACKGROUND OF THE INVENTION

The present invention relates generally to tent structures and, in a preferred embodiment thereof, more particularly provides a quick set-up tent having a specially designed collapsible integral frame structure.

Modern camping tents and the like are conventionally provided with a fabric shell section and a separate support frame structure which must be erected and then secured to the shell section to operatively support it in its shelter-defining use position. As an example, in one common type of tent structure, external pole loops are secured to the fabric shell, and collapsible, segmented resilient pole members are erected and then appropriately threaded through the loops to support the shell. To collapse the tent structure and pack it for storage and transport, the pole members must be removed from their retaining loops and broken down, and the shell folded and/or rolled to a storage position.

Particularly for one person, the performance of these steps can be rather time consuming and fairly awkward. Additionally, since the poles and the fabric shell are removable from one another, the poles may be easily forgotten or lost.

In an attempt to alleviate these problems, various types of integral shell frame structures have been proposed. However, such conventional integral pole or frame structure may also be inconvenient, time consuming and awkward for one person to handle during the set up and collapse of the tent structure. Moreover, conventional integral frame or pole structures are quite often of a relatively complex configuration and are quite bulky in their collapsed configuration thereby making the collapsed tent structure in its storage and transport orientation relatively large and unwieldy.

In view of the foregoing it is accordingly an object of the present invention to provide a quick set-up tent structure which eliminates or minimizes above-mentioned and other problems commonly associated with conventional tent structures, and which may be rapidly and easily erected and collapsed by one person.

SUMMARY OF THE INVENTION

In carrying out principles of the present invention, in accordance with preferred embodiments thereof, a quick set-up tent is provided which includes a collapsible and foldable flexible cover structure having an integral, collapsible support frame structure.

The cover structure has a floor section which, by means of stake loops attached around its periphery, may be operatively secured to the ground in a relatively taut orientation. Secured around the periphery of the floor section is a wall section defined by mutually angulated wall portions which are intersecured at adjacent side edge portions thereof along elongated, essentially straight juncture areas of the cover structure.

The support frame structure comprises a series of telescopable pole members, each of which is movable between a releasably locked, axially extended support position and an axially retracted storage and use position. Each of the pole members extends longitudinally along one of the wall portion juncture areas and is secured at opposite end portions thereto. Adjacent ends of the pole members are pivotally intersecured in a manner permitting the pole members, in their retracted positions, to be inwardly pivoted against one another to form an axially foreshortened pole member bundle.

The collapsed cover structure may be suitably folded and wrapped around the pole member bundle, generally between its opposite ends, to conveniently bring the collapsed tent structure to a very compact, generally cylindrical storage and transport configuration. From such compact storage and transport orientation, the tent may be rapidly and quite easily re-erected, by a single person, simply by expanding the cover structure, operatively securing the floor section to the ground, and moving the various pole members to their releasably locked support positions.

Each of the wall sections, with the tent erected, is sloped inwardly and upwardly relative to the floor section. Because of this wall portion orientation, a horizontal wind load or other load on a given wall portion is resisted by the associated portion of the taut floor section to inhibit undesirable flexion of the frame structure, thereby eliminating the necessity of utilizing external tie ropes to stabilize the frame structure.

Because the frame structure, which is preferably carried internally of the cover structure, is designed to be at all times attached to the cover structure, the conventional possibility of separation of frame elements from the cover structure and possible loss of such frame elements is essentially eliminated. To further facilitate the overall compactness of the tent structure, suitable ground stakes are provided which may be conveniently stored in a pouch structure secured to the inner surface of one of the wall portions of the cover structure. Accordingly, all elements necessary to quickly erect the tent are conveniently associated with the cove structure and are compactly and securely held in the cover structure in its rolled storage and transport configuration.

DETAILED DESCRIPTION

Figure 1:
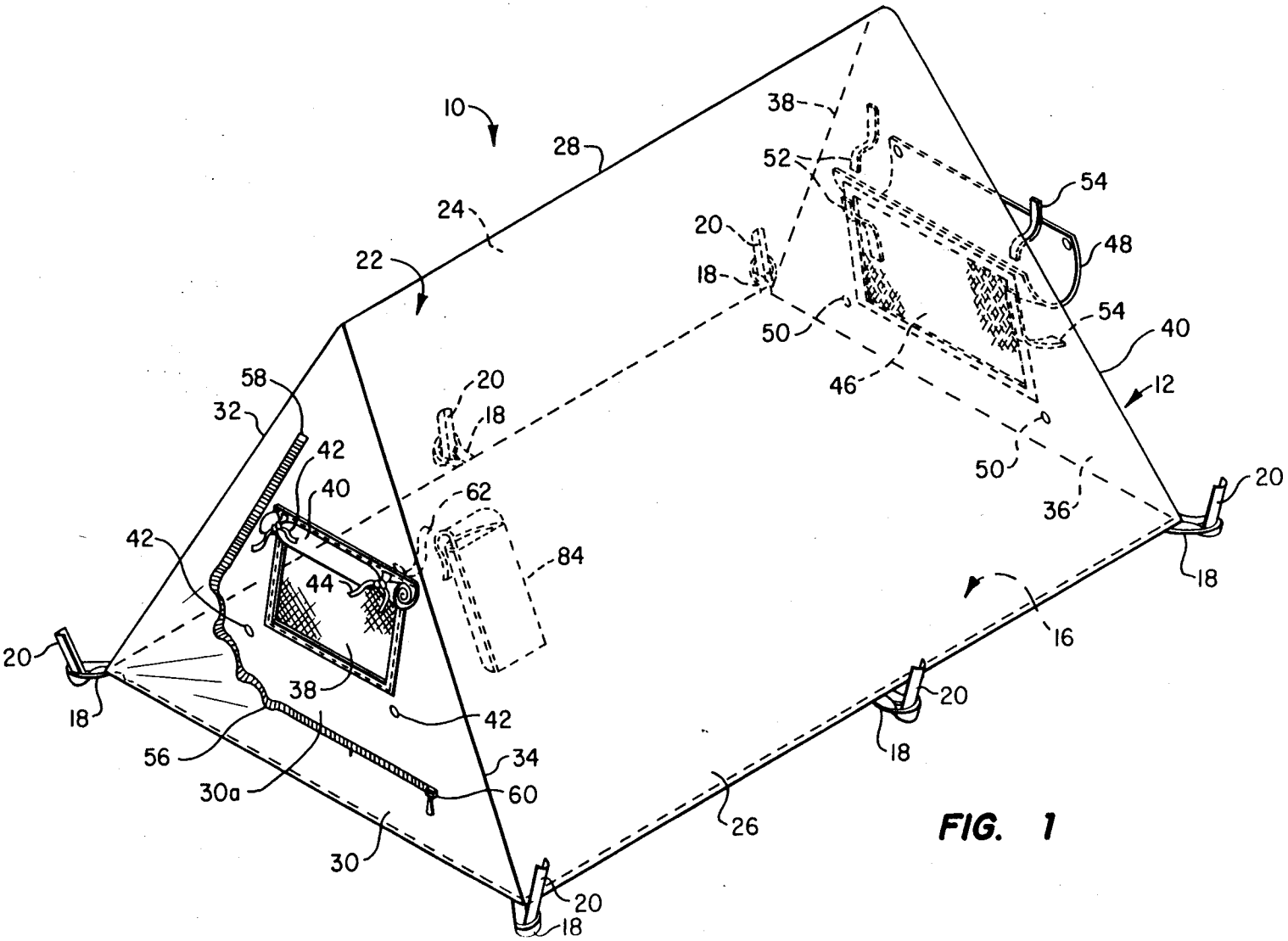
FIG. 1 is a perspective view of a collapsible, quick set-up tent, in its erected position, that embodies principles of the present invention.
Figure 2B:
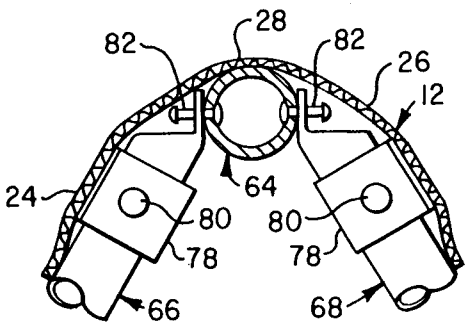
FIG. 2B is an enlarged scale cross-sectional view through an upper left corner portion of the frame structure taken along line 2B—2B of FIG. 2A.
Figure 2A:
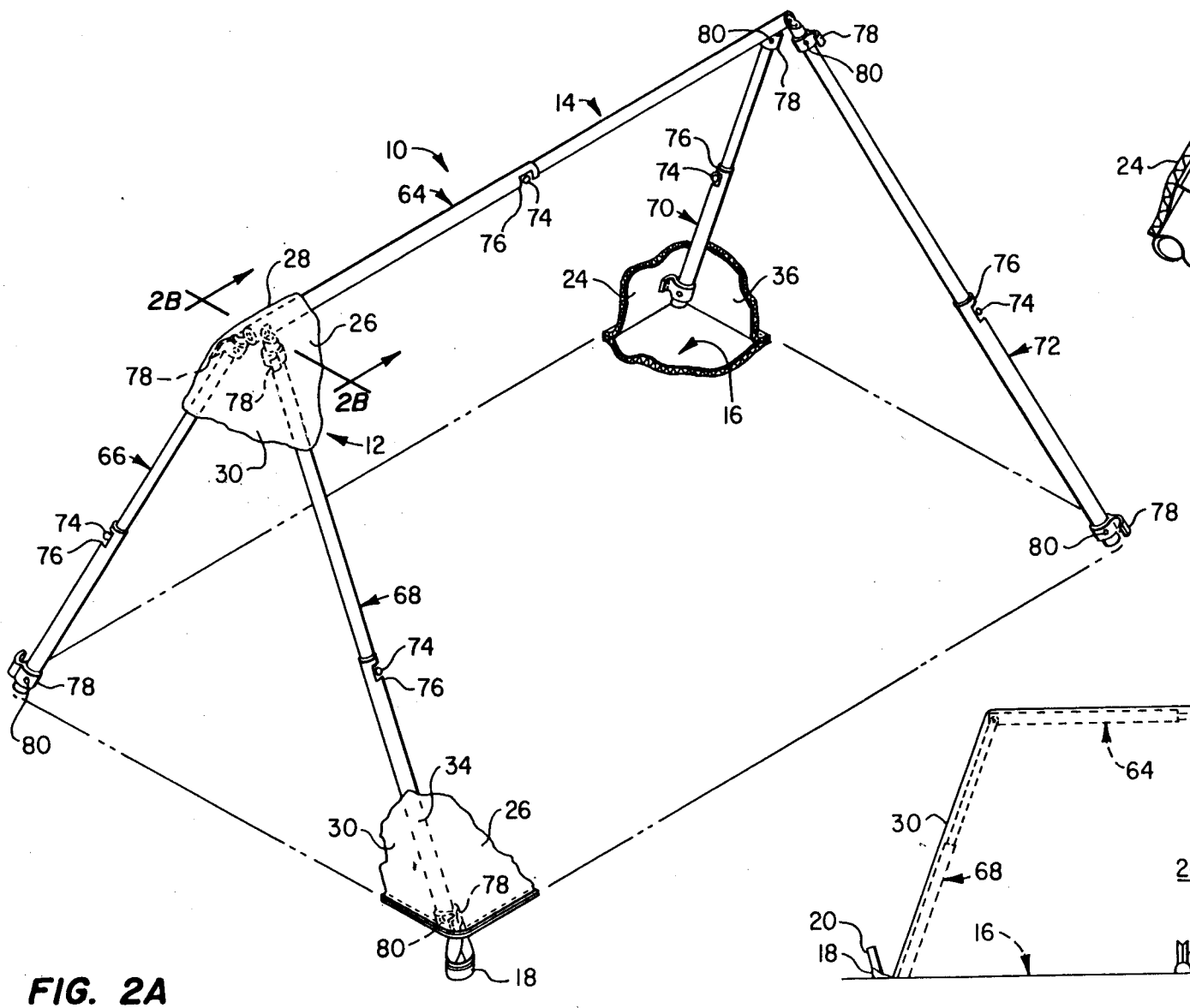
FIG. 2 is a view similar to that in FIG. 1, but with large portions of the outer cover section of the tent being cut away to more clearly illustrate its collapsible frame structure.

Illustrated in FIGS. 1 and 2A is a quick set-up tent 10 which embodies principles of the present invention and comprises a flexible fabric shelter-defining cover structure 12 which, with the tent 10 in its erected position depicted in FIGS. 1 and 2A, is internally supported by a collapsible frame structure 14 (FIG. 2A) permanently carried by the cover section 12. As will be seen, the tent 10 may be rapidly and quite easily erected and collapsed by one person, and has a compact storage and transport orientation which is facilitated by a unique configuration and operation of the frame structure 14.

Cover structure 12 includes an elongated rectangular floor section 16 having a series of ground stake loops 18 suitably attached around its periphery and adapted to be connected to ground stakes 20 to operatively position the floor section 16 along the ground in a relatively taut configuration. Cover structure 12 also includes a wall section 22 which is suitably secured along a lower side edge portion thereof to the floor section 16 around its periphery. Wall section 22 is defined by a pair of trapezoidally configured left and right side walls 24 and 26 joined at their upper side edges along a ridge line juncture area 28 of wall section 22, a triangular front end wall 30 joined at its side edges to the front side edges of side walls 24 and 26 along front end juncture areas 32 and 34 of the wall section 22, and a triangular rear end wall 36 joined along the side edges thereof to the rear side edges of walls 24 and 26 along rear end juncture areas 38 and 40.

Front end wall 30 is provided with a rectangular screened window section 38 having a roll-up cover flap 40 which may be selectively snapped into a closed position over the screen section 38 using small snap members 42 attached to the front end wall 30, or rolled to an open position as shown in FIG. 1 and tied in such open position using tie strap pairs 42 and 44. The rear end wall 36 is provided with a similar screened window section 46, a roll-up cover flap 48, a pair of closure snaps 50, and tie strap pairs 52 and 54 to releasably hold the cover flap 48 in its upwardly rolled open position. To provide ingress to and egress from the tent 10, the front end wall 30 is provided with a generally L-shaped zipper 56 having opposite ends 58 and 60, the zipper 56 being illustrated in its closed position in FIG. 1. Zipper 56 defines in the front end wall 30 a closeable flap section $30_a$ which, with the zipper 56 opened, may be rolled to an open position, in which the rolled flap $30_a$ extends between the opposite zipper ends 58 and 60, and then tied in such open position utilizing one of the tie straps 44 and an auxiliary tie strap 62 sewn to the interior surface of the front wall 30.

The collapsible frame structure 14 illustrated in FIG. 2A comprises five telescopable support pole members—a ridge pole member 64 extending interiorly along the upper wall juncture area 28, a pair of front end support pole members 66 and 68 extending interiorly along the wall juncture areas 32 and 34, and a pair of rear end support pole members 70 and 72 which extend interiorly along the wall juncture areas 38 and 40. Each of the support pole members is formed from two telescoping axial sections which are relatively movable between an axially foreshortened retracted position and an extended support position (depicted in FIGS. 2A and 3) in which the sections are releasably locked by means of spring loaded detent members 74 carried by the smaller diameter pole sections and snapped into corresponding slots 76 formed in their associated larger diameter pole sections.

The upper and lower ends of the front support pole members 66 and 68 and the rear support pole members 70 and 72 are anchored to the cover structure 12 (FIGS. 2A and 2B) by small strap loops 78 which are sewn to the cover structure 12, encircle the ends of the front and rear support pole members, and are anchored to their opposite ends by small rivets 80. The upper ends of the front pole members 66, 68 and the rear pole members 70, 72 are pivotally secured to the front and rear ends of the ridge pole member 64, as by elongated rivet members 82 (FIG. 2B), in a manner permitting the front and rear support pole pairs, during breakdown of the tent as subsequently described, to be pivoted toward each other and inwardly along the ridge pole member 64.

Figure 3:
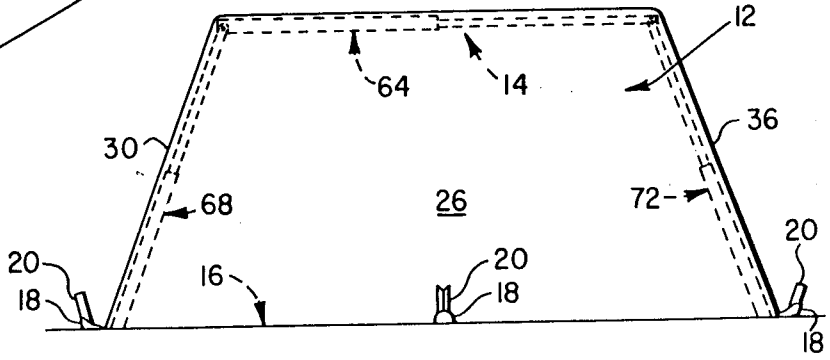
FIG. 3 is a reduced scale side elevational view of the tent as depicted FIG. 1.

As illustrated in FIGS. 1 and 3, the four walls 24, 26, 30 and 36 of the cover structure 12 slope upwardly and inwardly relative to the floor section 16 when the tent is in its erected configuration. This slope of the cover wall portions of the tent 10 functions to automatically stabilize the frame structure 14 against undesirable flexion caused, for example, by horizontal wind loads. For example, a rightward flexion of the frame structure 14 (as viewed in FIG. 3) caused by a rightwardly directed wind load on the front wall 30 is resisted by a resultant increase in the tension of the rear wall 36 which is anchored along its lower side edge to the floor section 16 that is in turn anchored to the ground by the stakes 20. The upward and inward sloping of the four walls of the tent 10 thus eliminates the necessity to externally stabilize the frame structure 14 by means of, for example, external tie lines.

Figure 4A:
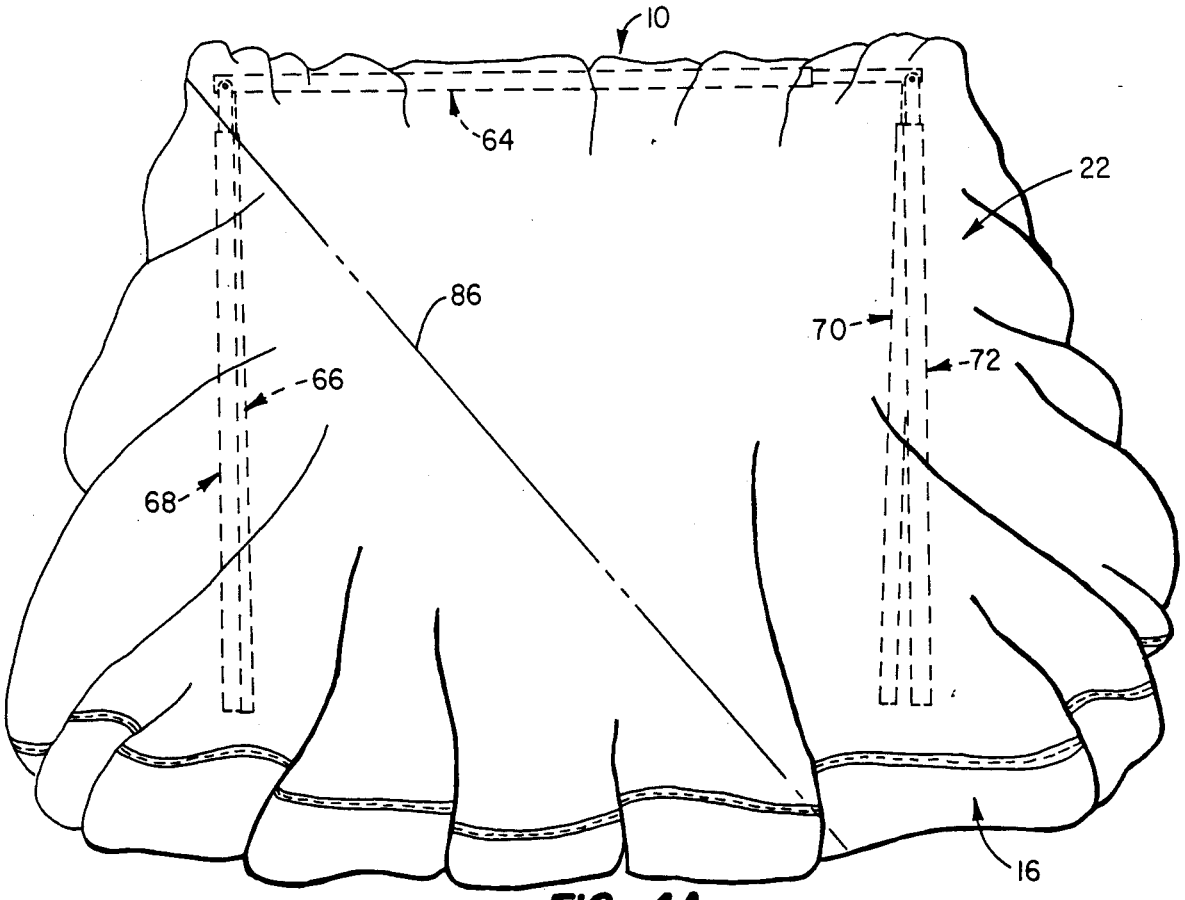
FIGS. 4A–4E are elevational views of the tent sequentially illustrating the manner in which it may be collapsed, folded and rolled into a compact storage and transport configuration.
Figure 4B:
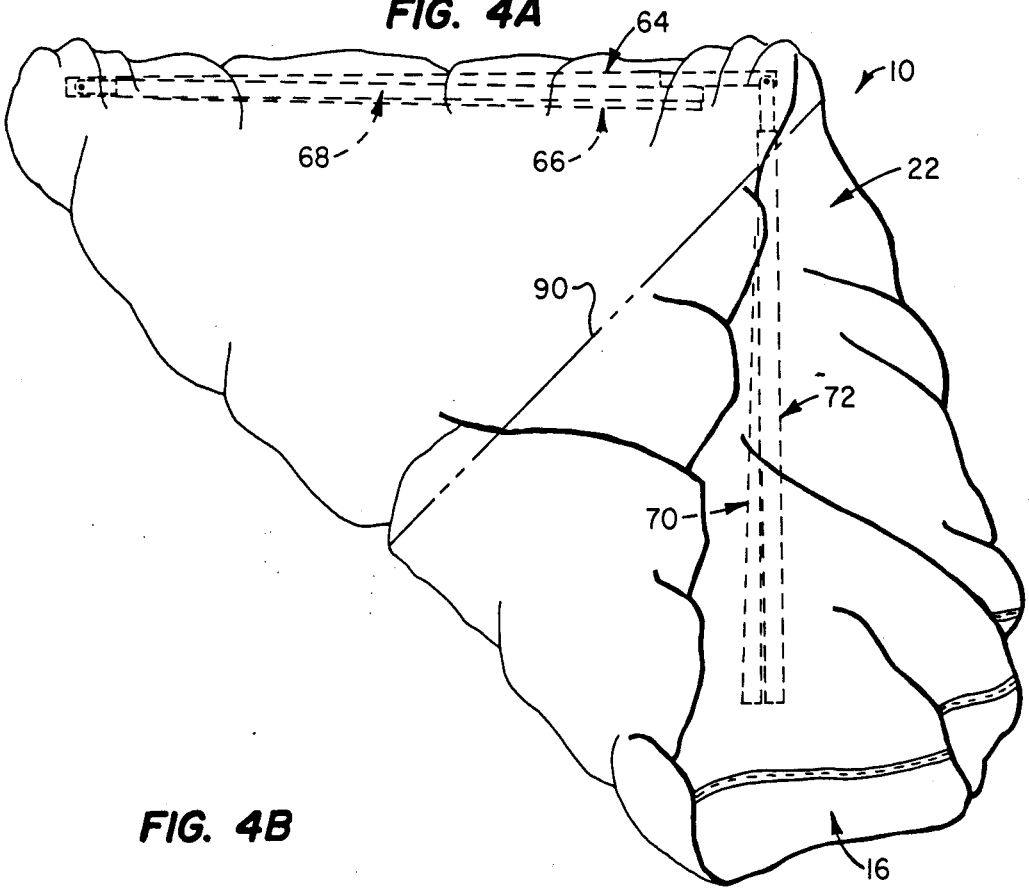

From its erected position depicted in FIGS. 1, 2A and 3, the tent 10 may be rapidly broken down by one person, and folded and rolled to a very compact storage and transport orientation as will now be described in conjunction with FIGS. 4A–4E. To effect this rapid breakdown of the tent 10, the stakes 20 are removed and placed in a stake pouch 84 (FIG. 1) secured to the interior surface of the side wall 26 adjacent the front end wall 30, the support poles are moved to their retracted positions (FIG. 4A), the front poles 66, 68 and the rear poles 70, 72 are pivoted inwardly against each other, and the collapsed tent 10 is positioned on its side on the ground as depicted in FIG. 4A. The retracted front end poles 66, 68 are then pivoted in a counterclockwise direction against the ridge pole 64, and the bloused floor and wall sections 16, 22 are folded along the diagonal fold line 86 to bring the collapsed tent 10 to the configuration depicted in FIG. 4B.

Figure 4C:
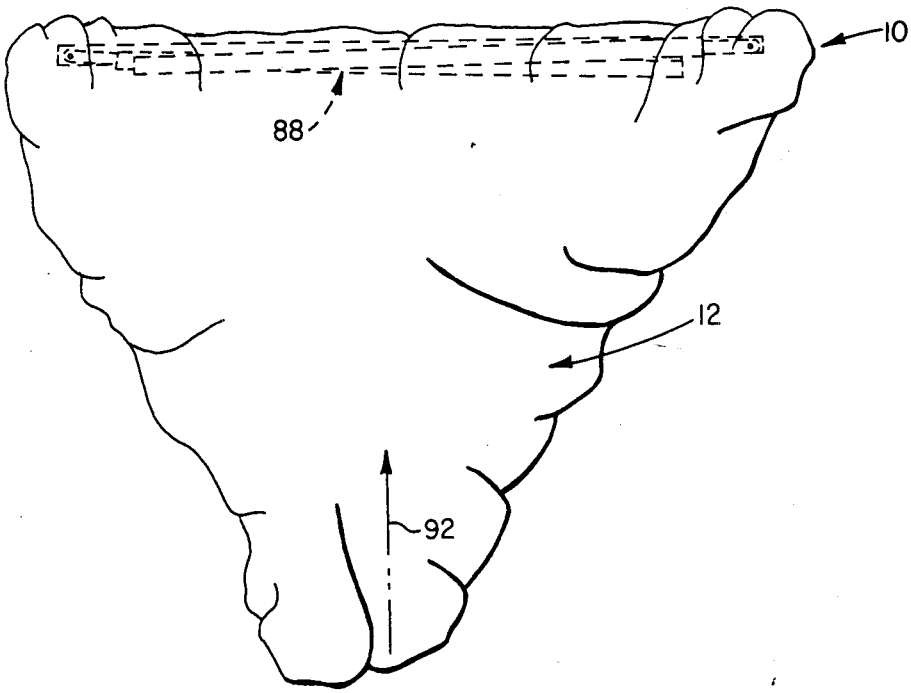
Figure 4D:
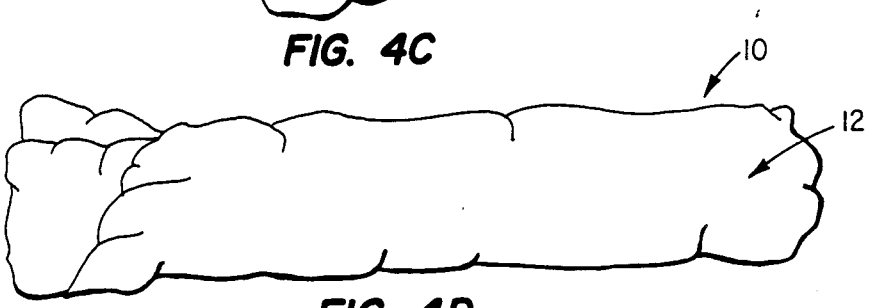
Figure 4E:
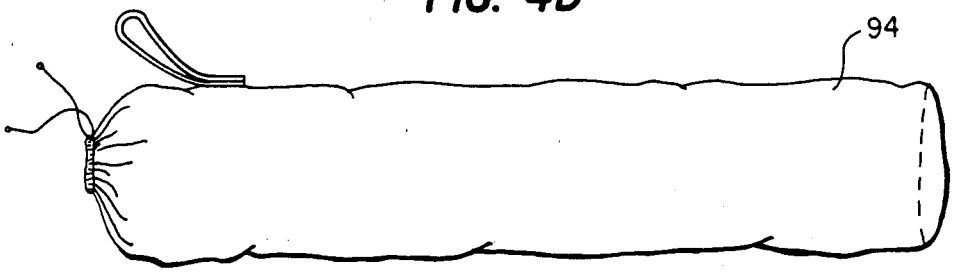

The retracted rear end poles 70, 72 are then pivoted in a clockwise direction against the other retracted poles to form therewith an axially foreshortened support pole bundle 88 (FIG. 4C), and the bloused floor and wall sections 16, 22 are folded along the fold line 90 (Floor B) to bring the collapsed tent 10 to the configuration illustrated in FIG. 4C. The folded cover structure 12 is then tightly rolled around the support pole bundle 88 (as indicated by the arrow 92 FIG. 4C), generally between its opposite ends, to bring the tent 10 to its compact, generally cylindrical storage and transport configuration shown in FIG. 4D. Importantly, in this storage and transport orientation, all of the components necessary to erect and support the flexible cover structure 12 (i.e., the frame structure 14 and the stakes 20) are conveniently rolled within the cover structure. The cylindrical tent bundle shown in 4D may then be placed in a suitable cylindrical stuff bag 94 until it is desired to re-erect the tent 10.

The tent 10 may be rapidly and quite easily re-erected, by one person, simply by removing the tent from its stuff bag 94, expanding the cover structure 12, staking the floor section 16 in a relatively taut configuration to the ground, and then moving each of the five retracted support pole members to its axially extended, releasably locked support position illustrated in FIG. 2A. The speed with which the tent 10 can be erected by a single person is of course, significantly facilitated by the collapsible support structure which is an integral part of the tent. This eliminates the necessity of erecting the support structure in a piecemeal fashion and then laboriously connecting it to the cover portion of the tent.

While the frame structure 14 has been illustrated as being carried internally within the cover structure 12, it will readily be appreciated that, if desired, it could be secured externally to the cover structure. With the frame structure externally mounted in this manner, the tent erection and breakdown steps described above would be carried out in the same convenient manner. The anchoring of the support pole members at their opposite ends to the cover structure permits the fabric of the cover structure to be conveniently bloused between such opposite support member ends when the support members are moved to their retracted positions, thereby facilitating the previously described representative folding and rolling operations.

Figure 5:
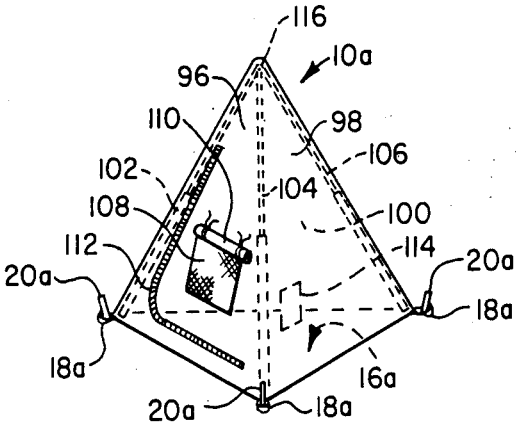
FIG. 5 is a perspective view of a first alternate embodiment of the tent in an erected position.
Figure 6:
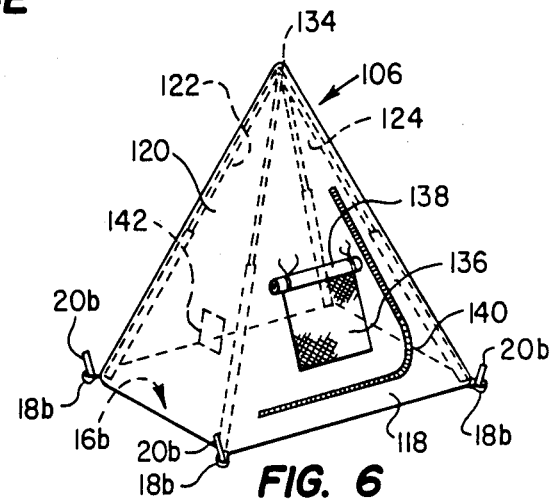
FIG. 6 is a perspective view of a second alternate embodiment of the tent in an erected position.

The tent 10 could be provided with a variety of alternative configuration as representatively indicated by the alternate tent embodiments $10_a$ and $10_b$ respectively depicted in FIGS. 5 and 6. Tent $10_a$ is of a three-sided pyramidal configuration and includes a triangular floor section $16_a$ provided at its corners with stake loops $18_a$ which operatively receive ground stakes $20_a$. The wall section of tent $10_a$ is defined by three triangularly shaped walls 96, 98 and 100 secured at their lower side edges to the floor section $16_a$ around its periphery, and the frame structure comprises three telescopable support pole members 102, 104, and 106 extended internally along the three side edge juncture areas defined at the intersections of adjacent side edge portions of the three walls and secured at their opposite ends to the cover structure as previously described in conjunction with the support poles of tent 10.

A screened window section 108, a roll-up cover flap 110, and a generally L-shaped door opening zipper 112 are provided on the wall 96. Secured to the inner surface of the wall 100 adjacent the wall 96 is a stake pouch 114 adapted to receive and store the ground stakes $20_a$ when the tent $10_a$ is not in use.

The support poles 102, 104 and 106 are pivotally interconnected at their upper ends, as at 116, so that the three poles, when moved to their retracted positions, may be pivoted inwardly against each other to form an axially foreshortened support pole bundle (similar to the pole bundle 88 previously described) about which the collapsed cover structure may be suitably wrapped to position the tent $10_a$ in a compact, generally cylindrical storage and transport configuration similar to that previously described in conjunction with the tent 10. The upward and inward slope of the three walls 96, 98 and 100 stabilizes the erected tent so that external tie ropes are not required. From its compact storage and transport orientation, the tent $10_a$ may be rapidly re-erected by one person simply by expanding the cover structure, staking the floor section $16_a$ to the ground, and then moving the three support poles 102, 104 and 106 to their releasably locked, axially extended support position depicted in FIG. 5.

Tent $10_b$ is similar to tent $10_a$ except that it has a four-sided pyramidal configuration when erected. Tent $10_b$ has a rectangular floor section $16_b$ provided at its corners with stake loops $18_b$ for receiving ground stakes $20_b$, four triangular walls 118, 120, 122 and 124 secured at their lower side edges to the floor section $16_b$ around its periphery, and an internal collapsible frame structure defined by four telescopable support poles 126, 128, 130 and 132. As in the case of the previously described support poles of the tents 10 and $10_a$, these four poles extend along the side edge juncture areas of the cover structure of tent $10_b$, are secured at their opposite ends to the cover structure, and are pivotally connected at their upper ends, as at 134, to permit the four support poles in their retracted positions to be pivoted inwardly against each other to form an axially foreshortened support pole bundle about which the collapsed cover structure may be suitably wrapped to bring the tent $10_b$ to its compact storage and transport orientation as previously described for tents 10 and $10_a$. A screened window section 136 with a roll-up cover flap 138, and a generally L-shaped door flap zipper 140 are formed in the wall 118, and a stake pouch 142 for receiving and storing the stakes $20_b$ is suitably secured to the interior surface of the wall 120 adjacent the wall 118. Erection and break down of the tent $10_b$ may be carried out in the manner described in conjunction with the three-sided pyramidal tent $10_a$.

It can be seen from the foregoing that the present invention provides a unique quick set-up tent structure which may be easily erected and broken down by a single person without the previous necessity of separately erecting the frame structure and then connecting it to the flexible cover structure portion of the tent. In its compact storage and transport orientation, the tent carries with it all of the support structure (namely the stakes and the support frame structure) needed to erect the tent. Accordingly, both the erection and breakdown of the tents 10, $10_a$ and $10_b$ are made significantly easier and more rapid.

The foregoing detailed description is to be clearly understood as being given by way of illustration and example only, the spirit and scope of the present invention being limited solely by the appended claims.

What is claimed is:

1. A quick set-up tent comprising:

collapsible and foldable flexible cover means expandable to a use position in which said flexible cover means may be supported to define an enclosed shelter, said flexible cover means having a floor section positionable along the ground, and a wall section having a lower edge portion secured to said floor section around its periphery;

means for operatively securing peripheral portions of said floor section to ground stakes or the like to hold said floor section against the ground in a flattened, relatively taut configuration; and collapsible support frame means permanently carried internally by said flexible cover means for supporting the same in said use position, said collapsible support frame means being defined by at least three telescopable pole members each connected at both ends thereof to said wall section at spaced apart locations thereon for movement with said wall section as it is collapsed and expanded, each of said pole members having an end pivotally connected directly to one end of at least one other pole member, each of said pole members having a releasably lockable extended position usable to support a portion of said flexible cover means in said use position, and an axially foreshortened retracted position, said pole members in said retracted positions thereof being pivotable relative to one another into a side-by-side, axially foreshortened bundle having opposite end portions with substantially identical lateral dimensions, whereby said flexible cover means, when collapsed, may be suitably folded and wrapped around said bundle, generally between its opposite ends, to conveniently position said tent in a compact, generally cylindrical storage and transport configuration, said tent being rapidly and easily re-erectable simply by expanding said flexible cover means, operatively securing said floor section to the ground, and moving said pole members to their releasably locked extended positions.

2. The quick set-up tent of claim 1 wherein:

said telescopable pole members are each attached only at opposite end portions thereof to said wall section.

3. The quick set-up tent of claim 1 wherein:

said wall section is defined by at least three mutually angulated wall portions which, when said tent is erected, slope upwardly and horizontally inwardly relative to said floor section.

4. The quick set-up tent of claim 3 wherein:

said tent, when erected, has a generally pyramidal shape.

5. The quick set-up tent of claim 3 wherein:

said wall section is defined by four mutually angulated wall portions and said tent, when erected, has a horizontally extending central ridge line positioned above said floor section.

6. The quick set-up tent of claim 1 wherein:

said pole members are attached interiorly to said flexible cover means.

7. A quick set-up tent, comprising:

collapsible and foldable flexible cover means expandable to use position in which said flexible cover means may be supported to define an enclosed shelter, said flexible cover means having a floor section positionable along the ground, and a wall section having a lower edge portion secured to said floor section around its periphery;

ground stake members for use in operatively securing said floor section to the ground, a pouch structure secured to an inside surface portion of said wall section and adapted to receive and store said ground stake members when said tent is not in use;

means for operatively securing peripheral portions of said floor section to ground stakes or the like to hold said floor section against the ground in a flattened, relatively taut configuration, said means for operatively securing including a spaced series of stake loops secured around a lower peripheral edge portion of said cover means; and collapsible support frame means permanently carried and internally by said flexible cover means for supporting the same in said use position, said collapsible support frame means being defined by at least three telescopable pole members each connected at both ends thereof to said wall section at spaced apart locations thereon for movement with said wall section as it is collapsed and expanded, each of said pole members having an end pivotally connected directly to one end of at least one other pole member, each of said pole members having a releasably lockable extended position useable to support a portion of said flexible cover means in said use position, and an axially foreshortened retracted position, said pole members in said retracted positions thereof being pivotable relative to one another into a side-by-side, axially foreshortened bundle having opposite end portions with substantially identical lateral dimensions, whereby said flexible cover means, when collapsed, may be suitably folded and wrapped around said bundle, generally between its opposite ends, to conveniently position said tent in a compact, generally cylindrical storage and transport configuration, said tent being rapidly and easily re-erectable simply by expanding said flexible cover means, operatively securing said floor section to the ground, and moving said pole members to their releasably locked extended positions.

8. A quick set-up tent comprising:

a collapsible and foldable flexible cover structure expandable to a use position in which it may be supported to define an enclosed shelter, said cover structure having a floor section and a wall section secured at a lower edge portion thereof to said floor section around its periphery, said wall section being defined by first, second, third and fourth mutually angulated wall portions, said first and second wall portions being in an opposed relationship, having front and rear side edges, and having upper side edges intersecured along an elongated first wall juncture area which extends generally horizontally over said floor section when said tent is erected, said third wall portion having a pair of side edges secured to said front side edges of said first and second wall portions along second and third wall juncture areas, said fourth wall portion having a pair of side edges secured to said rear side edges of said first and second wall portions along fourth and fifth wall juncture areas;

means for operatively securing peripheral portions of said floor section to ground stakes or the like to hold said floor section against the ground in a flattened, relatively taut configuration;

a collapsible frame structure permanently carried by said cover structure for supporting said cover structure in said use position thereof, said collapsible frame structure including:

a first telescopable pole member secured at each end to and extendible along said first wall juncture area for movement with said cover structure as it is collapsed and expanded and being movable between a releasable locked, axially extended support position and an axially retracted storage and transport position, second and third telescopable pole member respectively secured at each of their ends to and extendable along said second and third wall juncture areas for movement with said cover structure as it is collapsed and expanded and being movable between releasable locked, axially extended support positions and axially retracted storage and transport positions, said second and third pole members having upper end portions directly connected to a first end portion of said first pole member in close adjacency thereto and being pivotable relative to said first pole member about axes parallel and transverse thereto, and fourth and fifth telescopable pole members respectively secured at each of their ends to and extendable along said fourth and fifth wall juncture areas for movement with said cover structure as it is collapsed and expanded and being movable between releasably locked, axially extended support positions and axially retracted storage and transport positions, said fourth and fifth pole members having upper end portions directly connected to a second end portion of said first pole member in close adjacency thereto and being pivotable relative to said first pole member about axes parallel and transverse thereto, whereby said second, third, fourth and fifth pole members in said retracted positions thereof may be pivoted inwardly along said first pole member in said retracted position thereof to form therewith a foreshortened pole bundle having opposite end portions with substantially identical lateral dimensions so that said cover structure in a collapsed orientation may be suitably folded and wrapped around said bundle, generally between its opposite ends, to orient said tent in a compact, generally cylindrical storage and transport configuration, said tent being rapidly and easily re-erectable simply by expanding said cover structure, operatively securing said floor section to the ground, and moving the retracted pole members to their releasably locked support positions.

9. The quick set-up tent of claim 8 wherein:

said pole members are attached only at opposite end portions thereof to said cover structure.

10. The quick set-up tent of claim 8 wherein:

said first and second wall portions have generally trapezoidal configurations, and said third and fourth wall portions have generally triangular configurations.

11. The quick set-up tent of claim 8 wherein:

said collapsible frame structure is carried internally of said flexible cover structure.

12. The quick set-up tent of claim 8 further comprising:

ground stake members for use in operatively securing said floor section to the ground, and a pouch structure secured to an inside surface portion of said wall section and adapted to receive and store said ground stake members when said tent is not in use, and wherein said means for operatively securing include a spaced series of stake loops secured around a lower peripheral edge portion of said cover structure.

13. A quick set-up tent having a generally pyramidal erected configuration, comprising:

a collapsible and foldable flexible cover structure expandable to a use position in which it may be supported to define an enclosed shelter, said cover structure having a floor section and a wall section secured at a lower edge portion thereof to said floor section around its periphery, said wall section being defined by at least three mutually angulated, generally triangular wall portions joined at adjacent side edge portions thereof along juncture areas of said wall section;

means for operatively securing peripheral portions of said floor section to ground stakes or the like to hold said floor section against the ground in a flattened, relatively taut configuration; and a collapsible frame structure permanently carried internally by said cover structure for supporting said cover structure in said use position, said collapsible frame structure including at least three telescopable pole members attached at each of their opposite ends to and extendable along said juncture areas for movement with said cover structure as it is collapsed and expanded, each of said pole members being movable between a releasably locked, axially extended support position and an axially retracted storage and transport position, said pole members being directly pivotally interconnected at upper ends thereof in a manner permitting said pole members in their retracted positions to be pivoted inwardly against each other to form an axially foreshortened pole bundle about which said cover structure, in a collapsed configuration, may be wrapped to orient said tent in a compact, generally cylindrical storage and transport configuration, said axially foreshortened pole bundle having opposite end portions with substantially identical lateral dimensions, said tent being rapidly and easily re-erectable simply by expanding said cover structure, operatively securing said floor section to the ground, and moving said pole members to their releasably locked, axially extended support positions.

14. The quick set-up tent of claim 13 wherein:

said tent, when erected, has a three-sided pyramidal configuration.

15. The quick set-up tent of claim 13 wherein:

said tent, when erected, has a four-sided pyramidal configuration.

16. The quick set-up tent of claim 13 wherein:

said frame structure is carried internally by said cover structure.

17. A quick set-up tent having a generally pyramidal erected configuration, comprising:

a collapsible and foldable flexible cover structure expandable to a use position in which it may be supported to define an enclosed shelter, said cover structure having a floor section and a wall section secured at a lower edge portion thereof to said floor section around its periphery, said wall section being defined by at least three mutually angulated, generally triangular wall portion joined at adjacent side edge portions thereof along juncture areas of said wall section;

ground stake members for use in operatively securing said floor section to the ground, a pouch structure secured to an inside surface portion of said wall section and adapted to receive and store said ground stake members when said tent is not in use;

means for operatively securing peripheral portions of said floor section to group stakes or the like to hold said floor section against the ground in a flattened, relatively taut configuration, said means for operatively securing including a spaced series of stake loops secured around a lower peripheral edge portion of said cover structure; and a collapsible frame structure permanently carried and internally by said cover structure for supporting said cover structure in said use position, said collapsible frame structure including at least three telescopable pole members attached at each of their opposite ends to and extendable along said juncture areas for movement with said cover structure as it is collapsed and expanded, each of said pole members being movable between a releasably locked, axially extended support position and an axially retracted storage and transport position, said pole members being directly pivotally interconnected at upper ends thereof in a manner permitting said pole members in their retracted positions to be pivoted inwardly against each other to form an axially foreshortened pole bundle about which said cover structure, in a collapsed configuration, may be wrapped to orient said tent in a compact, generally cylindrical storage and transport configuration, said axially foreshortened pole bundle having opposite end portions with substantially identical lateral dimensions, said tent being rapidly and easily re-erectable simply by expanding said cover structure, operatively securing said floor section to the ground, and moving said pole members to their releasable locked, axially extended support positions.

18. The quick set-up tent of claim 13 wherein:

said pole members are attached to said cover structure only at opposite end portions of said pole members.

* * * * *

UNITED STATES PATENT AND TRADEMARK OFFICE

CERTIFICATE OF CORRECTION

PATENT NO. : 4,974,621

DATED : December 4, 1990

INVENTOR(S) : Larry Lerma

It is certified that error appears in the above-identified patent and that said Letters Patent is hereby corrected as shown below:

Col. 2, line 33 [page 3, line 28], "cove" should be --cover--.

Col. 4, line 68 [page 8, line 30], insert --,-- after "is".

Col. 7, line 54-55 [amended Claim 7, line 21], delete "permanently carried and internally" and insert --permanently and internally carried--.

Col. 8, line 50 [amended Claim 8, line 31], "releasable" should be --releasably--.

Col. 10, line 53 [amended Claim 17, line 18], "group" should be --ground--.

Signed and Sealed this

Twenty-third Day of February, 1993

*Attest:*

STEPHEN G. KUNIN

*Attesting Officer*

*Acting Commissioner of Patents and Trademarks*